United States Patent [19]

Oda

[11] 4,008,511

[45] Feb. 22, 1977

[54] DEVICE FOR ADJUSTING POSITION OF TAKER-IN UNDER CASING IN CARD

[75] Inventor: Shingo Oda, Nagoya, Japan

[73] Assignee: Kabushiki Kaisha Toyoda Jidoshokki Seisakusho, Kariya, Japan

[22] Filed: Sept. 3, 1975

[21] Appl. No.: 610,007

[30] Foreign Application Priority Data

Sept. 10, 1974 Japan ..... 49-103509

[52] U.S. Cl. ..... 19/105

[51] Int. Cl.[2] ..... D01G 15/42

[58] Field of Search ..... 19/105, 95, 98

[56] References Cited

UNITED STATES PATENTS

| | | | |
|---|---|---|---|
| 454,986 | 6/1891 | Platt et al. | 19/105 X |
| 461,595 | 10/1891 | Shoefelt et al. | 19/95 |
| 485,680 | 11/1892 | Canning | 19/105 |

*Primary Examiner*—Dorsey Newton

[57] ABSTRACT

A taker-in under casing in a carding machine is disposed below a taker-in roller and between an under casing for a cylinder and a dish plate so as to extend along a portion of the lower peripheral surface of the taker-in roller. In order to vary the spacing between the taker-in under casing and the dish plate and/or the gauge between the taker-in under casing and the taker-in roller to thereby control the quantity and a quality of substances to be removed at the taker-in under casing, the latter is provided with a device for adjusting the position of the taker-in under casing, which is manually operable at the outside of the carding machine. The adjusting device has a first adjusting mechanism for causing the taker-in under casing to slide along the circumference of the taker-in roller, and a second adjusting mechanism for causing the taker-in under casing to pivot toward and away from the taker-in roller, these mechanisms being operable independently of each other.

11 Claims, 5 Drawing Figures

DEVICE FOR ADJUSTING POSITION OF TAKER-IN UNDER CASING IN CARD

BACKGROUND OF THE INVENTION

This invention relates generally to a carding machine and more particularly to a device for adjusting the position of a taker-in under casing relative to one or both of a taker-in roller and a dish plate in the carding machine.

As is well known, it is one of main functions of a taker-in under casing to carry out separation of impurities, which are unworthy of being used for spinning, from a satisfactory fiber material. The separation is effected in a manner that the satisfactory fiber material, which is easily gripped by a taker-in roller provided with a fiber-gripping surface, for example in the form of a Garnett wire, is allowed to pass through between the taker-in roller and the taker-in under casing along with a resulting stream of air whereas the impurities, such as dirt having a relatively large terminal speed sufficient to overcome the function of the resulting air stream, and short fibers which are too short to be gripped by the taker-in roller, and thrown out of the taker-in roller and dropped through the taker-in under casing. It is possible to control both the quantity and a quality of impurities to be removed at the taker-in under casing by adjusting both or either of the spacing between the downstream end of the dish plate and the upstream end of the taker-in under casing and the gauge between the taker-in roller surface and the taker-in under casing at the upstream end thereof.

Heretofore, the following proposals have been provided to bring about a desired separation of impurities at the taker-in under casing:

1. To vary the leading gauge between the taker-in roller and the taker-in under casing.
2. To replace the taker-in under casing with one having a different length.
3. To adjust the position of a mote knife, that is to vary the gauge between the mote knife and the taker-in roller.

With respect to the proposal (1), since the prior taker-in under casing is mounted on a machine frame in an unadjustable manner, the taker-in under casing has to be disadvantageously removed from the machine frame whenever practising the proposal. As readily understood, such a disadvantage is also present for the proposal (2). In addition, in the case of the proposal (3), the mote knife may cause an undesirable stream of air to be created particularly when it is applied to a high speed card and this proposal is therefore not only unsuitable for the high speed card, but lacking in reliability of its ability to separate impurities.

Thus, it is understood that all of the prior proposals require complicated and skilled adjusting operation of the taker-in under casing or the mote knife and therefore they are not satisfactory.

SUMMARY OF THE INVENTION

It is accordingly an object of this invention to provide a device for adjusting the position of a taker-in under casing, which eliminates the abovementioned disadvantages of the prior proposals and is capable of being operated from outside of a carding machine without requiring removal of the taker-in under casing from a support therefor.

In brief, the invention resides in a carding machine comprising a cylinder, a taker-in roller for stripping a lap and feeding it to the cylinder, a dish plate arranged on the lap feed side of the taker-in roller, a taker-in under casing adjustably arranged below the taker-in roller and on the downstream side of the taker-in roller relative to the dish plate, and means for adjusting the position of the taker-in under casing without removing the taker-in under casing from the carding machine, the adjusting means including at least one or first adjusting mechanism so placed that it is operated from outside of the carding machine. The taker-in under casing is adjustably carried by supporting means, which is associated with the adjusting means so that when the adjusting means is operated from outside of the carding machine the supporting means allows the position of the taker-in under casing to change relative to one or both of the dish plate and the taker-in roller.

Therefore, one or both of the spacing between the taker-in under casing and the dish plate and the gauge between the taker-in under casing and the taker-in roller can be adjusted with ease merely by operating the adjusting member from outside of the carding machine.

BRIEF DESCRIPTION OF THE DRAWINGS

This invention will become more readily apparent from the following detailed description taken in conjunction with the accompanying drawing in which.

DESCRIPTION OF THE PREFERRED EMBODIMENTS

Figure 1:
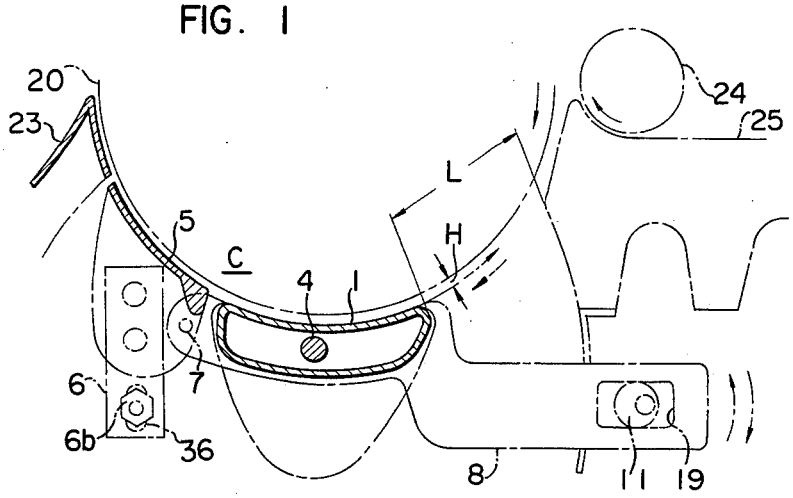
FIG. 1 is a fragmental cross-sectional view of a taker-in under casing disposed below a taker-in roller.

Referring now to the drawing and particularly FIG. 1, there is fragmentarily shown a carding machine including a taker-in roller 20, a dish plate 25 arranged on the lap feed side of the taker-in roller 20, a feed roller 24 disposed above the dish plate 25 to feed fiber material toward the taker-in roller 20, and a cylinder under casing 23 arranged on the lap delivery side of the taker-in roller 20 and below a conventional cylinder (not shown). A taker-in under casing C is disposed below roller 20 and between the cylinder under casing 23 and the dish plate 25 so that undesirable matters, such as impurities and short fibers are separated from the lap at the taker-in under casing due to the action of a stream of air generated by rotation of the taker-in roller 20.

In order to adjust the quantity and quality of what is to be removed at the taker-in under casing C, it is required to change the position of the taker-in under casing C, that is, to vary one or both of the spacing L between the downstream end or nose of the dish plate 25 with respect to movement of the lap and the upstream end of the taker-in under casing C with respect to movement of the lap and the gauge H between the cylindrical surface of the taker-in roller 20 and the downstream end or tail of the taker-in under casing C.

Figure 2:
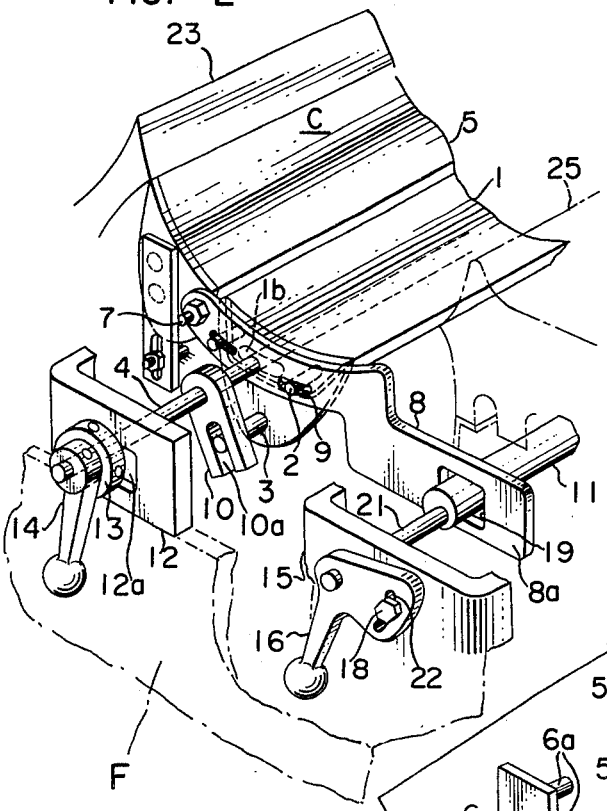
FIG. 2 is a fragmental perspective view showing a device for adjusting the position of the taker-in under casing of FIG. 1.
Figure 3:
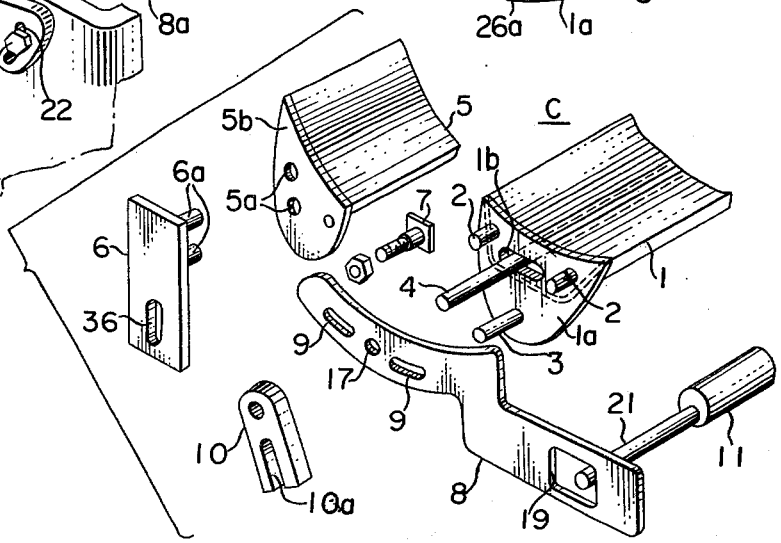
FIG. 3 is an exploded perspective view of the adjusting device shown in FIGS. 1 and 2.

In FIGS. 1 to 3, the taker-in under casing C comprises a movable upstream half 1, and a downstream half 5 which is placed downstream relative to the movement of the lap and supported normally stationary. Both the upstream and downstream halves 1 and 5 have curved inner surfaces extending along lower portions of the cylindrical surface of the taker-in roller 20. Means for supporting and adjusting the taker-in under casing C may be provided on both the left and right hand sides of the taker-in under casing C. However, in the drawings only the supporting and adjusting means on the left side are shown, since both supporting and adjusting means on the left and right are identical with each other. The downstream half 5 is supported by brackets 6, which have pins 6*a* extending inwardly into complementary holes 5*a* provided in an end plates 5*b* of the downstream half 5 and have an oblong slot 36 provided therein through which bolt and nut assemblies 6*b* (see FIG. 1) extends to adjustably connect the brackets 6 to a not shown machine frame. It is therefore understood that the gauge between the downstream half 5 and the taker-in roller 20 is adjustable when necessary.

With respect to the upstream half 1, the weight thereof is mainly supported by plate members 8 at each end thereof and rotatable shafts 4 and 11 on brackets 12 and 15 on opposite sides of the carding machine. The brackets 12 and 15 can be fixedly connected to the machine frame F (only partially shown) in a conventional manner. In order to allow the upstream half 1 to move along the cylindrical surface of the taker-in roller 20, that is, to make the spacing L between the upstream end of the movable half 1 and the nose of the dish plate 25 adjustable, there is provided a first adjusting mechanism, wherein the shaft 4 extends through an oblong slots 1*b* provided in end plates 1a and the hollow interior of the upstream half 1; the plate members 8 each have curved oblong slots 9 provided therein on the opposite sides of the shaft 4 to allow pins 2 extending outwardly from the end plates 1*a* to engage therein; the shaft 4 has a U-shaped driving member 10 fixed thereonto and the driving member has therein a slot 10*a* in which a pin 3 which is fixedly connected to the end plate 1*a* of the upstream half 1 is engaged; and the shaft 4 is adapted to have the free end thereof project through an opening 17 provided in one of the plate members 8 out of the not shown machine frame so that a control lever 14 fixed onto the free end of the shaft 4 can be operated from the outside of the carding machine. A collar 13 is mounted on the shaft 4 between one of the brackets 12 and the control lever 14 to lock or fix the shaft 4 and accordingly the upstream half 1 in a selected position.

In order to allow the upstream end of the movable half 1 to move toward and away from the taker-in roller 20, that is, to make the gauge H between the taker-in roller 20 and the upstream end of the movable half 1 adjustable, there is provided a second adjusting mechanism, wherein the plate members 8 are pivotably connected to the upstream end portion of the downstream half 5 by a bolt and nut assemblies 7; each plate member 8 has an extension 8a extending along the machine, an opening 19 being provided in the extension 8*a* to allow the passage of the shaft 11 therethrough, which has a smaller diameter pin 21 eccentrically connected to the end thereof and the pin 21 is adapted to have the free end project out of the not shown machine frame so that a control lever 16 fixed onto the free end of the pin 21 can be operated from outside of the carding machine. An oblong slot 22 is provided in the control lever 16 to permit the latter to be held in a selected position in cooperation with a lock nut 18. An opening 12*a* provided in each bracket 12 which is of a size sufficient to allow the shaft 4 to move therein along with the plate member 8.

Although in this example the taker-in under casing C is divided into two halves, it may have a onepiece integral form. In this case, the plate members 8 are pivotably connected to a suitable stationary member, such as the cylinder under casing 23, the machine frame or the like, instead of being mounted to the downstream half 5.

The slots 9 act as a guide for the pins 2, so that each slot 9 preferably has a radius of curvature so as to allow the upstream half 1 to move parallel with the cylindrical surface of the taker-in roller 20.

When it is desired to adjust the spacing L, a machine operator is required only to turn the control lever 14 into the predetermined position after having loosened the lock collar 13, whereby the shaft 4 as well as the bifurcated driving member 10 is rotated to cause the pin 3 to slide inwardly or outwardly in the open slot 10*a* of the driving member 10, resulting in the movement of the upstream half 1 into its predetermined position along the cylindrical surface of the taker-in roller 20. Then, the lock collar 13 is fastened to complete the adjustment of the spacing L. During this operation, the taker-in under casing C is adjustably carried by the supporting means, and there is no need for removal of the taker-in under casing from the card.

When it is required to adjust the gauge H, both the lock collar 13 and the lock screw 18 are loosened and thereafter only the control lever 16 is operated to turn it to its desired position, whereby the plate member 8 makes a pivotal motion due to the eccentric connection of the shaft 11 to the pin 21. Therefore, the upstream half 1 is also moved toward and away from the taker-in roller 20 and into its selected position, providing a desired value of gauge H. Thereafter, the control lever 16 is fixed in its desired position by fastening the lock collar 13 and the lock screw 18. As will be understood, since the shaft 11 is always supported by the bracket 15, there is no fear that the taker-in under casing C will be removed from the card during this adjustment.

Figure 4:
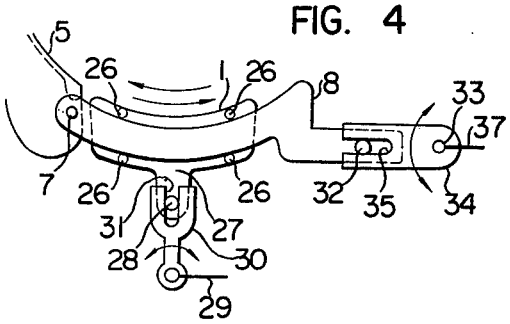
FIGS. 4 and 5 are side elevations of different embodiments of the invention.

In FIG. 4, another embodiment of the invention is shown, wherein the load of the upstream half 1 is supported mainly through the plate members 8 at opposite ends thereof, at least one having, a pin 32, a corresponding bifurcated plate member 34 and a shaft 33 on the not shown machine frame. A first adjusting mechanism causing the upstream half 1 to move in the directions shown by the arrows comprises four pins 26 arranged in contact with the upper and lower curved edges of each plate member 8, an outwardly extending pin 28 provided on a downward extensions 27 on at least one end of the upstream half 1, a bifurcated member 30 receiving a portion of the pin 28 therein, and a control lever 29 integral with the bifurcated member 30. The control lever 29 can be associated with means for holding it in the selected position, such as the lock collar 13 shown in FIG. 2. A second adjusting mechanism causing the upstream half 1 to move toward and away from the taker-in roller 20 comprises the outwardly extending pin 32 mounted on at least one plate member 8, the bifurcated plate member 34 provided with an open slot 35 to receive the pin 32 therein, the shaft 33 turnably supported by the not shown machine frame and integral with the plate member 34, and a control lever 37 securely fixed to the extension of the shaft 34 and extending outwardly through the machine frame. The control lever 37 also can be associated with similar means for holding it in the selected position. The center of curvature of each curved edge of each plate member, with which the pins 26 are in contact, is substantially on the rotational axis of the taker-in roller 20.

In this embodiment, when the control lever 29 as well as the bifurcated member 30 is turned in the clockwise or counterclockwise direction, the upstream half 1 is moved in the opposite direction due to engagements of the pins 26 with the upper and lower curved edges of the plate members 8, resulting in the aforementioned spacing L being adjusted. When it is required to adjust the gauge H, the bifurcated plate member 34 is similarly turned in the clockwise or counterclockwise direction to cause the plate members 8 to turn in the opposite direction about the bolt 7. At this time, the not shown means for holding the control lever 29 is preferably loosened to allow smooth movement of the upstream half 1, which has the pin 28 engaged in the open slot of the bifurcated plate member 30.

Figure 5:
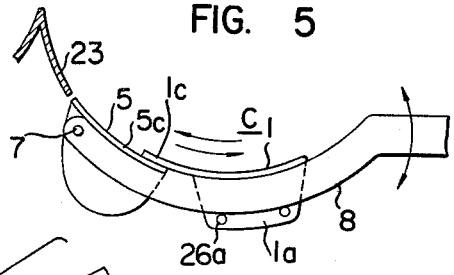

Still another embodiment shown in FIG. 5 discloses an upstream half 1 having an extension 1*c* thereof partially overlapped with the downstream half 5. The extension 1*c* projects from the downstream end of the movable half 1 and expands over an upstream surface portion of the statiory half 5 so that even when the spacing L is adjusted, there occurs no clearance between the upstream and downstream halves 1 and 5. Although not shown in FIG. 5, the movable half 1 can be associated with the first and second adjusting mechanisms as shown in FIG. 2 or 4 to make the spacing L and the gauge H adjustable. The plate members 8 are mounted for pivotal motion on the downstream end of the downstream half 5 as shown at 7 and pass along the side edge portion 5*c* of the downstream half 5 and then between the extension 1*c* and pins 26*a* mounted on the end plates 1*a* of the upstream half 1. Therefore, when the plate members 8 are caused by the second adjusting mechanism to make the pivotal motion, the upstream and downstream halves 1 and 5 also make the pivotal motion, resulting in adjustment of the gauge H, and when only the first adjusting mechanism is operated, the upstream half 1 moves relative to the downstream half 5 along the plate members 8, resulting in adjustment of the spacing L.

Although various specific embodiments have been described above, it will be readily understood by those skilled in the art that various rearrangements of parts and modifications of parts may be accomplished without departing from the spirit and scope of the invention as defined in the appended claims.

What I claim is:

1. A carding machine which comprises:

a. a taker-in roller for stripping and feeding a lap;

b. a dish plate and cooperating feed roller positioned on the lap feed side of said taker-in roller;

c. a taker-in under casing below said taker-in roller and on the downstream side of said taker-in roller relative to said dish plate, said under casing comprising a movable half disposed on the upstream side with respect to the movement of the lap, and a stationary half disposed on the downstream side with respect to the movement of the lap;

d. supporting means pivotally supported on said machine and supporting said movable half for turning movement around the pivotal support of said supporting means and circumferential movement along a portion of the circumference of said taker-in roller;

e. a first adjusting means associated with said movable half for causing said movable half to turn around the pivotal support point of said supporting means; and f. a second adjusting means associated with said movable half for causing said movable half to move circumferentially along the portion of the circumference of said taker-in roller, said second adjustable means being operable independently of said first adjusting means.

2. The carding machine as claimed in claim 1, wherein said supporting means supports said movable half for sliding movement therealong.

3. The carding machine as claimed in claim 1, wherein said supporting means comprises a plate member at each end of said movable half and pivotably connected to a portion of said stationary half and supporting said movable half in load bearing relationship, and a supporting shaft extending substantially in parallel with said movable half and supporting said plate members in load bearing relationship therewith.

4. A carding machine as claimed in claim 3, wherein said movable half has an extension thereon partially overlapping said stationary half, said movable half being movably mounted on said plate member for movement toward said taker-in roller.

5. The carding machine as claimed in claim 3, wherein said supporting shaft has a portion supported by and extending outward of said carding machine.

6. A carding machine as claimed in claim 5, wherein said first adjusting mechanism comprises a control lever arranged outward of said carding machine, a shaft member connected to said control lever and movably supported by said carding machine and first motion transmitting means connected between said shaft member and said movable half to transmit the motion of said shaft member to said movable half when said control lever is operated; and said second adjusting mechanism comprises a further control lever connected to the outwardly projecting portion of said supporting shaft, and second motion transmitting means arranged between said supporting shaft and said plate members to transmit the motion of said supporting shaft to said plate members.

7. A carding machine as claimed in claim 6, wherein said first and second adjusting mechanisms comprise respectively first and second means for locking said first and second control levers into respective controlled positions.

8. A carding machine as claimed in claim 6, wherein said first motion transmitting means comprises a bifurcated member fixed to said shaft member, a pin extending from one end of said movable half and engaged in said bifurcated member, and a pin and slot assembly provided between one of said plate members and said movable half to allow said movable half to move toward and away from said dish plate when said first control lever is operated.

9. A carding machine as claimed in claim 8, wherein said second motion transmitting means comprises a cam means having a surface engaging said one plate member with the pivotal motion.

10. A carding machine as claimed in claim 8, wherein said first motion transmitting means comprises a bifurcated member fixed to said shaft member, a pin extending from one end of said movable half and engaged in said bifurcated member, and guide pins extending from one end of said movable half and said movable half being guided between and supported by said guide pins for movement toward and away from said dish plate.

11. A carding machine as claimed in claim 10, wherein said second motion transmitting means comprises a bifurcated member fixed to the projecting portion of said supporting shaft, and a pin extending from a free end portion of one of said plate member and engaged in said bifurcated members of said second motion transmitting means whereby said plate member makes the pivotal motion when said second control lever is operated.

* * * * *